United States Patent [19]

Hashimoto et al.

[11] Patent Number: 4,977,870

[45] Date of Patent: Dec. 18, 1990

[54] INTERNAL COMBUSTION ENGINE

[75] Inventors: Hiroshi Hashimoto, Chigasaki; Tatsuo Aruga, Kawasaki; Eiichi Fujisawa; Yoshinari Obana, both of Yokohama, all of Japan

[73] Assignee: Nissan Motor Co., Ltd., Yokohama, Japan

[21] Appl. No.: 477,084

[22] Filed: Feb. 8, 1990

[30] Foreign Application Priority Data

Feb. 17, 1989 [JP] Japan ..... 1-37800

[51] Int. Cl.[5] ..... F02F 7/00; F01M 1/00

[52] U.S. Cl. ..... 123/195 C; 123/196 R; 123/198 E

[58] Field of Search ..... 123/196 R, 195 C, 198 E

[56] References Cited

U.S. PATENT DOCUMENTS

| | | | |
|---|---|---|---|
| 4,295,807 | 10/1981 | Krüger | 123/196 R |
| 4,483,278 | 11/1984 | Kolucz | 123/195 C |
| 4,607,601 | 8/1986 | Kohler | 123/195 C |
| 4,616,610 | 10/1986 | Ishida | 123/196 A |
| 4,648,363 | 3/1987 | Kronich | 123/196 A |
| 4,753,201 | 6/1988 | Fukuo et al. | 123/195 C |
| 4,883,031 | 11/1989 | Ampferer et al. | 123/195 C |

FOREIGN PATENT DOCUMENTS 62-11303 3/1987 Japan .

*Primary Examiner*—E. Rollins Cross

*Attorney, Agent, or Firm*—Pennie & Edmonds

[57] ABSTRACT

An internal combustion engine is disclosed, which comprises a cylinder block having lubrication oil passages formed therein, the oil passages having a cylinder block opening at one longitudinal end of the cylinder block; a crankshaft operatively installed in the cylinder block, the crankshaft having one end portion exposed to the outside of the cylinder block from the one longitudinal end of the same; and a front cover structure attached to the one longitudinal end of the cylinder block. The front cover structure includes a first portion having an oil pump housing formed thereon; an oil pump device driven by the exposed end portion of the crankshaft, the oil pump device being received in the oil pump housing; a second portion having first and second oil passages formed therein, the first oil passage having one end connected to an outlet port of the oil pump device, the second oil passage having one end which is mated with the cylinder block opening; and an oil filter fixed to the second portion and fluidly connected to the other ends of the first and second passages.

14 Claims, 5 Drawing Sheets

INTERNAL COMBUSTION ENGINE

BACKGROUND OF THE INVENTION

1. Field of the Invention

The present invention relates in general to internal combustion engines, and more particularly, to the engines of a type having a front cover structure secured to a front end of a cylinder block thereof.

2. Description of the Prior Art

In order to clarify the task of the present invention, one known internal combustion engine of the above-mentioned type will be described with reference to FIG. 6 of the accompanying drawings, which is disclosed in Japanese Utility Model Second Provisional Publication No. 62-11303.

In FIG. 6, designated by numeral 102 is a cylinder block of an internal combustion engine. The cylinder block 102 has a longitudinal end which is designated by numeral 103.

Designated by numeral 102A is an oil inlet opening formed in the cylinder block 102, from which an oil passage (not shown) extends to an opening of the cylinder block 102 to which opening an oil filter (not shown) is connected from the outside.

Designated by numeral 101 is a front cover structure which is to be bolted to the longitudinal end 103 of the cylinder block 102. As shown, the front cover structure 101 has an oil pump 104 mounted to an inside portion thereof. Designated by numeral 110 is an oil outlet opening formed in the front cover structure 101, from which an oil passage (not shown) extends to an outlet portion of the oil pump.

The oil pump 104 is of internal gear type, comprising a drive gear 104A which is connected to a crankshaft (not shown) to be driven by the same and a driven gear 104B which is rotatably disposed about the drive gear 104A having a part thereof operatively engaged with the drive gear 104A. Designated by numeral 107 is an oil strainer which has an upper end connected to the oil pump 104 and a lower enlarged end placed in an oil pan (not shown) of the engine.

In operation, the oil pump 104 sucks thereinto the oil from the oil pan through the oil strainer 107 and pumps the oil, thus pressurized, into the oil passage of the front cover structure 101 and into the oil passage of the cylinder block 102 through the outlet opening 110 and the inlet opening 102A. The oil in the oil passage of the cylinder block 102 is then conducted to various portions of the engine through the oil filter.

However, due to its inherent construction, the arrangement possessed by the above-mentioned known front cover structure 101 has the following drawbacks.

First, because the oil filter is connected to the cylinder block 102, the oil passage from the oil inlet opening 102A to the opening to which the oil filter is connected is very complicated in structure. Furthermore, due to the complicated structure of the oil passage in the cylinder block 102, the oil flowing along the oil passage of the cylinder block tends to be overly heated by the heat possessed by the cylinder block 102. As is known, the overly heated oil reduces its viscosity and thus its lubricating activity.

SUMMARY OF THE INVENTION

Therefore, it is an object of the present invention to provide an internal combustion engine of the above-mentioned type, which is free of the drawbacks possessed by the above-mentioned conventional structure.

According to the present invention, there is provided an internal combustion engine which comprises a cylinder block having lubrication oil passages formed therein, the oil passages having a cylinder block opening at one longitudinal end of the cylinder block; a crankshaft operatively installed in the cylinder block, the crankshaft having one end portion exposed to the outside of the cylinder block from the one longitudinal end of the same; and a front cover structure attached to the one longitudinal end of the cylinder block, wherein the front cover structure includes: a first portion having an oil pump housing formed thereon; an oil pump means driven by the exposed end portion of the crankshaft, the oil pump means being received in the oil pump housing; a second portion having first and second oil passages formed therein, the first oil passage having one end connected to an outlet port of the oil pump means, the second oil passage having one end which is mated with the cylinder block opening; and an oil filter fixed to the second portion and fluidly connected to the other ends of the first and second passages.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, an internal combustion engine according to the present invention will be described in detail with reference to the accompanying drawings.

Figure 2:
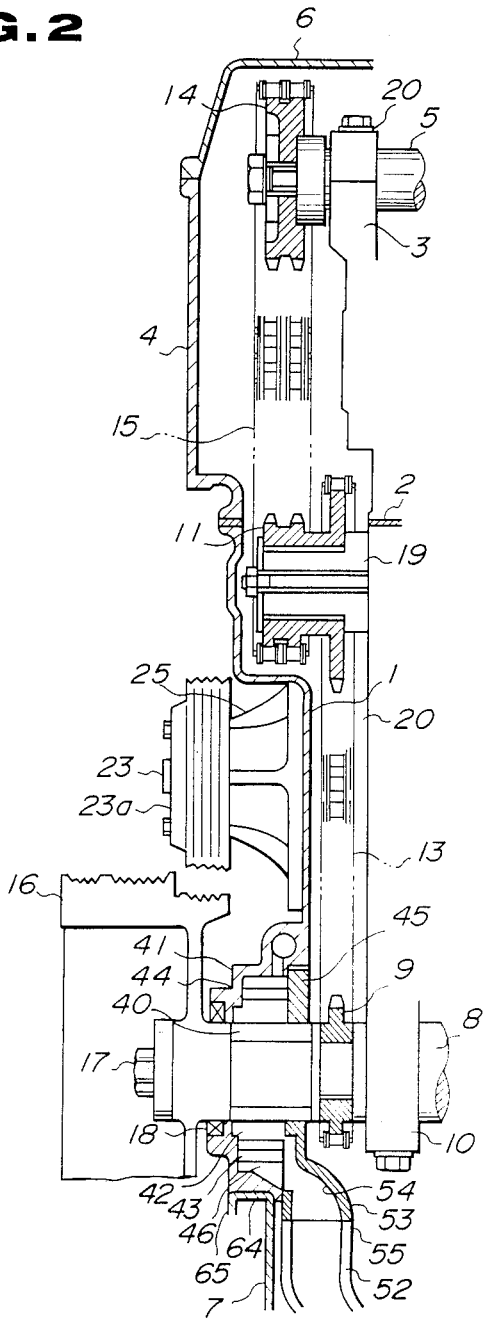
FIG. 2 is a vertically sectional view of a front part of an internal combustion engine, to which the front cover structure is to be secured.

Referring to FIG. 2, there is shown, but in a sectioned manner, a front portion of a V-type internal combustion engine, to which the present invention is practically applied. Denoted by numeral 4 is a front cover which is secured to a front end of a cylinder head of each bank of the V-type engine. Designated by numeral 6 is a rocker cover which covers both a cam shaft 5 and various valve parts driven by the cam shaft 5. Designated by numeral 7 is an oil pan which reserves a lubricating oil of the engine. Designated by numeral 10 is a bearing cap for a crankshaft 8. The crankshaft 8 has a cranksprocket 9 secured thereto.

Respective idler sprockets 11 are rotatably connected through shafts 19 to the respective cylinder blocks 2. A chain 13 is operatively put on the cranksprocket 9 and the two idler sprockets 11. Each cam shaft 5 has a cam sprocket 14 secured to a front end thereof. A chain 15 is operatively put on the cam sprocket 14 and the corresponding idler sprocket 11. Thus, rotational power of the crankshaft 8 is transmitted to the two cam shafts 5 through the respective idler sprockets 11.

To a front end of the crankshaft 8, there is secured through a bolt 17 a crankpulley 16. A belt (not shown) is operatively put on the crankpulley 16 and known auxiliary devices (not shown), so that the auxiliary devices are powered by the crankshaft 8.

As is seen from FIG. 2, a front cover structure 1 is attached to the front ends of the two cylinder blocks 2 having the crankpulley 16 exposed to the outside of the engine. For achieving this attachment, the front cover 1 has an aperture (no numeral) through which the front end of the crankshaft 8 passes. A seal ring 18 is tightly installed in the aperture to achieve a sealing between a hub portion of the crankpulley 16 and the front cover 1. The front cover 1 has a lower portion 65 mated with a flange 64 of the oil pan 7.

Figure 1:
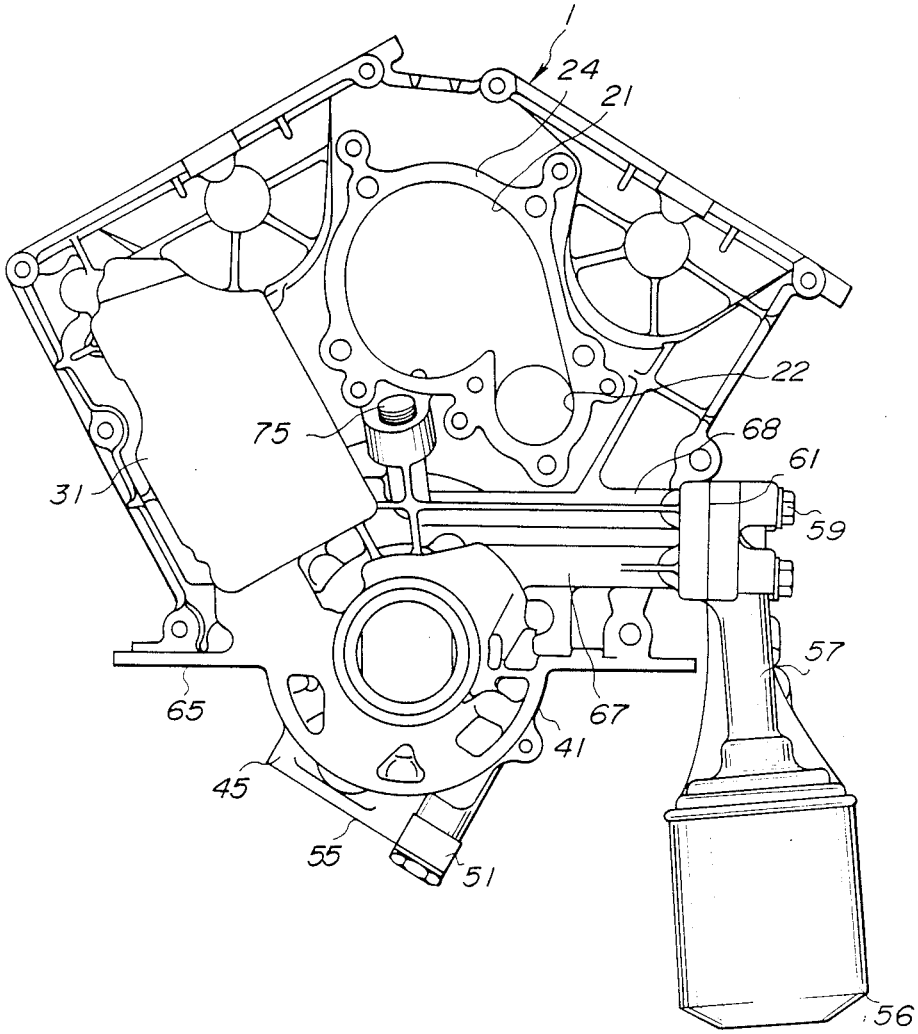
FIG. 1 is a front view of a front cover structure which is an essential part of an internal combustion engine of the present invention.

As is best shown in FIG. 1, the front cover structure 1 has at its upper middle portion a water pump mounting bank 21 integrally formed thereon. The mounting bank 21 has a flat seat portion 24 to which a flange portion of a separate pump housing 25 (see FIG. 2) is attached and secured. Within the pump housing 25, there is rotatably disposed a vane member (not shown) whose shaft 23 is partially exposed to the outside, as shown in FIG. 2. The exposed end of the shaft 23 has a pulley 23*a* secured thereto. A belt (not shown) is operatively put on the pulley 23*a* and the crankpulley 16 to drive the vane member.

Figure 3:
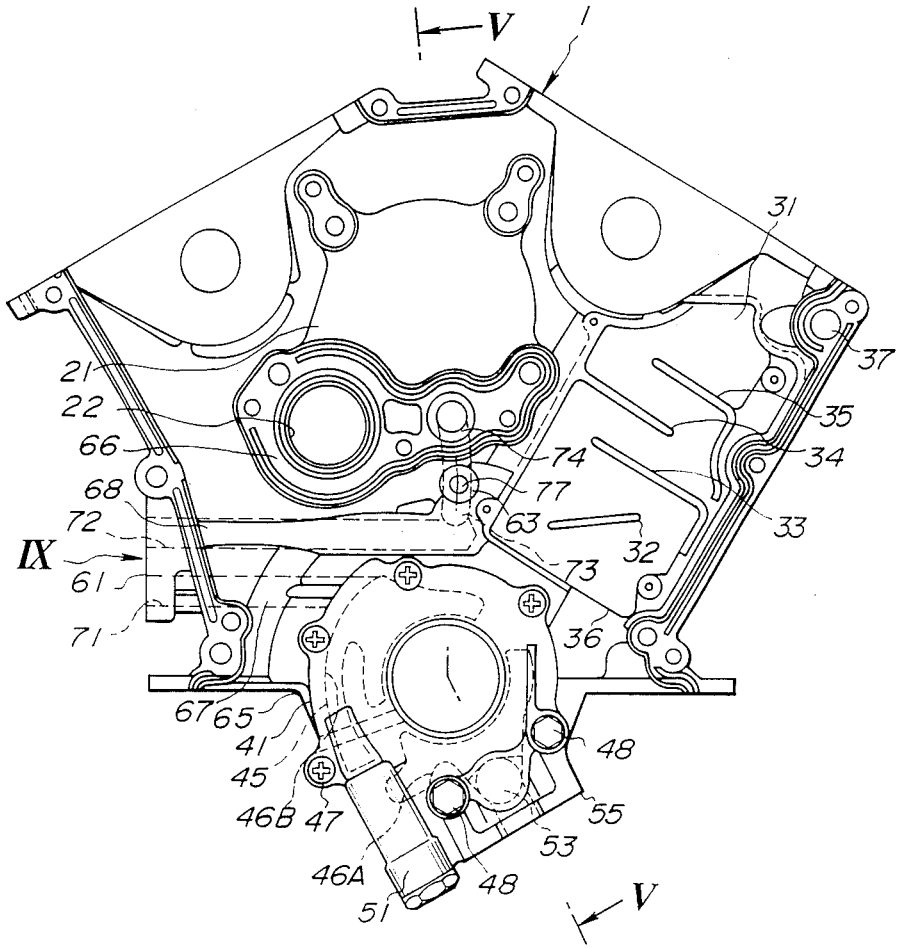
FIG. 3 is a back view of the front cover structure.

As is seen from FIGS. 1 and 3, the front cover structure 1 has an opening 22 which is exposed to the cavity defined by the mounting bank 21. Upon assembly, the opening 22 is sealingly mated with an inlet opening of a water jacket of one of the cylinder blocks 2, so that, under operation of the water pump thus assembled, cooling water is forced to flow from the opening 22 toward the water jacket.

As is understood from FIG. 3, the front cover structure 1 is provided at its right side (as viewed in this drawing) with an oil separator 31. The oil separator 31 comprises a plurality of spaced ribs 32, 33, 34 and 35 which are raised from the front cover structure 1 and a cover plate (not shown) which covers the ribs 32, 33, 34 and 35. With this, there is defined within the oil separator 31 a so-called "labyrinth passage". The oil separator 31 has at its lower portion an oil inlet opening 36 directed toward the oil pan 7. The oil separator 31 further has at its upper portion an oil outlet opening 37 connected to a tube (not shown) which leads to an air-intake passage of the engine. That is, the oil separator 31 and the tube constitute parts of a known "blow-by gas circulation system".

As is shown in FIGS. 1, 2 and 3, the front cover structure 1 further has an oil pump housing 41 integrally formed thereon. The oil pump housing 41 is so constructed as to surround the afore-mentioned aperture through which the front end of the crankshaft 8 passes. Thus, as is seen from FIG. 2, the oil pump housing 41 is located just behind the crankpulley 16.

As is seen from FIG. 2, to an inboard side of the oil pump housing 41, there is secured a rear cover 45. With this, an oil pump chamber 46 is defined in the housing 41. As is seen from FIG. 3, the securing of the rear cover 45 to the oil pump housing 41 is achieved by using four screws 47 and two bolts 48. Within the oil pump chamber 46, there are disposed mutually engaged drive and driven gears 42 and 43. The drive gear 42 is connected through a spacer 40 to the crankshaft 8 to rotate therewith. With this arrangement, a so-called internal gear pump 44 is assembled.

In FIG. 3, denoted by numerals 46A and 46B are oil inlet and outlet passages of the oil pump 44 respectively. As is seen from the same drawing, the rear cover 45 for the oil pump 44 is integrally formed at its left-lower portion (as viewed in the drawing) with a tubular valve housing 51. Within the valve housing 51, there is operatively disposed a valve body which, when assuming a given position relative to the housing 51, provides a passage directly connecting the inlet and outlet passages 46A and 46B of the pump 44.

As is seen from FIGS. 2 and 3, the rear cover 45 for the oil pump 44 has further at its right-lower portion (as viewed in FIG. 3) an inlet housing 53 integrally formed thereon. As shown in FIG. 2, one end of an oil strainer 52 is connected to the inlet housing 53, which strainer 52 leads to a bottom of the oil pan 7. The inlet housing 53 has at its inside portion an opening 54 (see FIG. 2) exposed to the inlet side of the oil pump chamber 46. As is seen from FIG. 3, the inlet housing 53 has at its lower portion an inclined flat surface 55 to which a flange of the oil strainer 52 is secured. Thus, under operation of the oil pump 44, the oil in the oil pan 7 is sucked into the oil pump 44 through the strainer 52.

Figure 4:
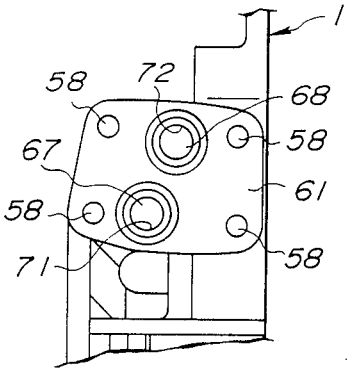
FIG. 4 is a view taken from the direction of the arrow "IX" of FIG. 3.

As is seen from FIGS. 1 and 4, the front cover structure 1 is integrally formed at its right-lower portion (as viewed in FIG. 1) with a connecting flange 61 to which a bracket 57 for an oil filter 56 is secured. As is seen from FIG. 4, the connecting flange 61 is formed with four threaded openings 58. For securing the bracket 57 to the connecting flange 61, four bolts 59 are passed through openings of the bracket 57 and screwed into the threaded openings 58 of the connecting flage 61. As shown in FIG. 1, the oil filter 56 is arranged to hang down from the bracket 57.

As is seen from FIGS. 1 and 3, the front cover structure 1 is integrally formed with both an oil intake passage 67 through which the oil flows from the oil outlet passage 46B of the oil pump chamber 46 toward the oil filter 56 and an oil outlet passage 68 through which the cleaned oil flows from the oil filter 56 toward a main oil gallery (not shown) in the cylinder block 2.

As is understood from FIG. 1, the oil intake passage 67 is formed in a horizontally extending bank formed on the outer side of the front cover 1. The passages 67 and 68 extend in parallel and horizontally, each having a horizontal part 71 or 72 at the contacting surface of the connecting flange 61.

Figure 5:
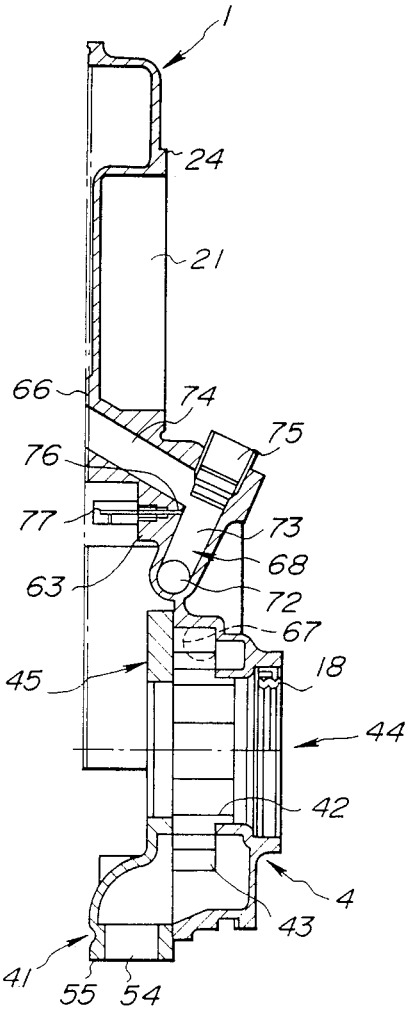
FIG. 5 is a sectional view taken along the line "V—V" of FIG. 3.
Figure 6:
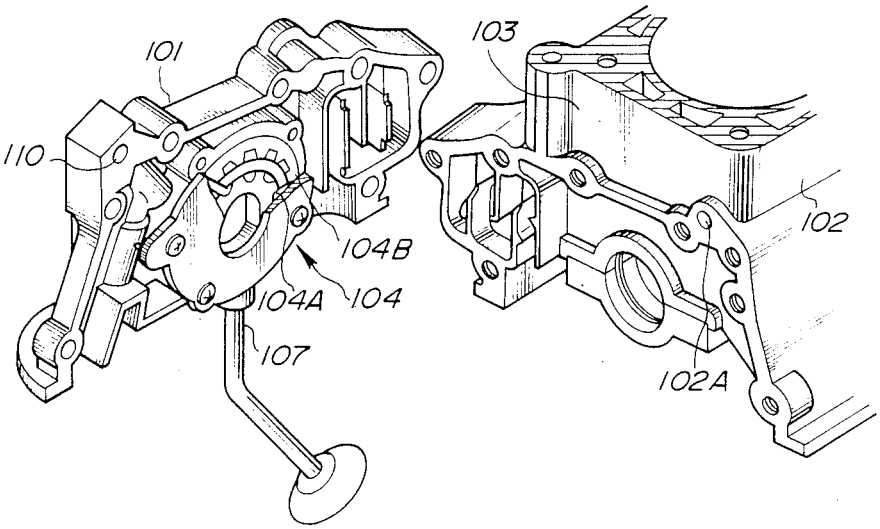
FIG. 6 (PRIOR ART)
FIG. 6 is an exploded view of an internal combustion engine, showing a conventional front cover structure of a cylinder block.

As is seen from FIG. 5, the oil outlet passage 68 comprises the horizontal part 72 extending in parallel with the oil intake passage 67, a first inclined part 73 extending from one end of the horizontal part 72 and a second inclined part 74 extending from the first inclined part 73 to a contracting surface 66 to which an associated contacting surface of the cylinder block 2 is secured.

The horizontal part 72 of the oil outlet passage 68 is formed in a horizontally extending bank formed on the outer side of the front cover structure 1. The first inclined part 73 of the passage 68 extends to an outer surface of the front cover structure 1 forming an opening (no numeral) at the same. A plug 74 is securedly and sealingly put in the opening.

As is seen from FIG. 5, a small passage (or orifice) 76 extends from an upper portion of the first part 73 of the oil outlet passage 68 to the inner side surface of the front cover structure 1 where a boss 63 is formed. An oil jet 77 is secured to the boss 63. The oil injecting nozzle of the oil jet 77 is directed toward the chain 13 (see FIG. 2). Thus, under operation of the engine, pressurized oil from the oil pump 44 is injected toward the chain 13.

As is seen from FIG. 3, the second inclined part 74 of the oil outlet passage 68 has at the contacting inner surface 66 an opening which is positioned near the opening 22 to which the water jacket of the cylinder block 2 is connected. Upon assembly, the opening of the second inclined part 74 is connected to the passage of the cylinder block 2 which passage leads to the main oil gallery in the cylinder block 2.

In the following, operation will be described.

Under operation of the engine, the rotation of the crankshaft 8 drives the cam shaft 5 through the chains 13 (see FIG. 2) and 15 and thus drives the various valve parts driven by the cam shaft 5.

Due to rotation of the crankshaft 8, the drive gear 42 and the driven gear 43 of the oil pump 44 are rotated keeping a meshed engagement therebetween. With this, the oil in the oil pan 7 is sucked into the oil pump chamber 46 through the oil strainer 52, and the oil thus pressurized by the oil pump 44 is fed into the oil filter 56 through the oil intake passage 67. The pressurized oil thus cleaned by the oil filter 56 is then fed to the main oil gallery of the cylinder block 2 through the oil outlet passage 68, from which the oil is applied to the various movable parts of the engine. During this, the oil in the small passage 76 (see FIG. 5) is injected from the oil jet 77 toward the chain 13.

When mounting the engine on an engine room, it is preferable to orient the same in such a manner that the front cover structure 1 is effectively exposed to a ventilation air in the engine room.

In the following, advantages obtained by the present invention will be described.

First, since the horizontally extending banks for the oil intake passage 67 and the oil outlet passage 68 (see FIG. 1) are exposed to the surrounding air, the heat radiation of the oil in such passages 67 and 68 is effectively carried out. In fact, the banks for the passages 68 are exposed to the eventilation air in the engine room. Thus, undersired over heating of the oil does not occur even when the engine is subjected to a high load operation.

Second, because the oil filter 56 is connected to the front cover 1 not to the cylinder block 2, the oil passage formed in the cylinder block 2 becomes relatively simple in construction. This promotes the protection against the oil overheating.

Third, since the oil jet 77 for supplying the chain 13 with the oil is connected to the middle part of the oil outlet passage 68, the structure of the oil passage becomes simplified as compared with the above-mentioned conventional engine.

Fourth, the integral provision of the oil pump housing 41, the water pump housing 21, the oil intake passage 67, the oil outlet passage 68 and the oil separator 31 on the front cover structure 1 brings about increased mechanical strength or stiffness of the front cover structure 1. In fact, the raised and depressed portions by which the portions 41, 21, 67, 68 and 31 are defined serve as reinforcing ribs of the front cover structure 1. Thus, undesired surface vibration of the front cover structure 1, which would produce noises, is minimized.

Fifth, since the oil pump 44 and the oil filter 56 can be assembled on the front cover structure 1 before the front cover structure 1 is connected to the cylinder block 2, the assembly of the engine becomes facilitated.

Although the foregoing description is directed to a front cover structure which is applied to a V-type engine, the present invention is also applicable to other type engines, such as In-line type engine, Opposed type engine and the like.

What is claimed is:

1. An internal combustion engine comprising:

a cylinder block having lubrication oil passages formed therein, said oil passages having a cylinder block opening at one longitudinal end of said cylinder block;

a crankshaft operatively installed in said cylinder block, said crankshaft having one end portion exposed to the outside of said cylinder block from said one longitudinal end of the same; and a front cover structure attached to said one longitudinal end of said cylinder block, wherein said front cover structure includes:

a first portion having an oil pump housing formed thereon;

an oil pump means driven by the exposed end portion of said crankshaft, said oil pump means being received in said oil pump housing;

a second portion having first and second oil passages formed therein, said first oil passage having one end connected to an outlet port of said oil pump means, said second oil passage having one end which is mated with said cylinder block opening; and an oil filter fixed to said second portion and fluidly connected to the other ends of said first and second passages.

2. An internal combustion engine as claimed in claim 1, in which said first and second portions are formed into a single piece.

3. An internal combustion engine as claimed in claim 2, in which said first and second oil passages of said second portion are respectively formed in and along horizontally extending banks which are formed on an outer side of said front cover structure.

4. An internal combustion engine as claimed in claim 3, in which said front cover structure further comprises an oil jet means which includes:

a limited passage formed in said second portion, said limited passage extending from said second passage; and an oil jet fixed to said second portion and fluidly connected to said limited passage, said oil jet being directed toward a movable part of the engine.

5. An internal combustion engine as claimed in claim 4, in which said second passage of said second portion includes a plurality of straight parts which are angled to one another.

6. An internal combustion engine as claimed in claim 5, in which one of said straight parts has an opening exposed to the outside of said second portion, said opening being plugged with a plug member.

7. An internal combustion engine as claimed in claim 6, in which said front cover structure further comprises:

a third portion which has a water pump mounting bank formed thereon; and a water pump means received in said water pump mounting bank, said water pump being powered by said crankshaft.

8. An internal combustion engine as claimed in claim 7, in which said third portion has formed therein third and fourth passages which extend from inlet and outlet ports of said water pump means respectively, said third and fourth passages having respective openings which are mated with respective ports of a water jacket formed in said cylinder block.

9. An internal combustion engine as claimed in claim 8, in which said front cover structure further comprises an oil separator which includes:

a fourth portion of said front cover structure, said fourth portion having a plurality of spaced ribs raised therefrom; and a cover plate covering said ribs to define in said fourth portion a labyrinth passage, one end of said labyrinth passage being exposed to an oil pan and the other end of said labyrinth passage being connected to a tube which leads to an air-intake passage of the engine.

10. An internal combustion engine as claimed in claim 1, in which said oil pump means comprises a rear cover which covers said oil pump housing of said first portion, said rear cover being provided with a bypass valve means which includes:

a tubular valve housing integrally formed on said rear cover; and a valve body operatively disposed in said valve housing, said valve body providing, when assuming a given position, a passage which directly connects inlet and outlet ports of said oil pump means.

11. An internal combustion engine as claimed in claim 10, in which said rear cover of said oil pump means further has an inlet housing which is merged with said inlet port of said oil pump means, said inlet housing having one end of an oil straining device connected thereto.

12. An internal combustion engine as claimed in claim 1, in which said oil filter is connected to said second portion through a bracket.

13. An internal combustion engine as claimed in claim 1, in which said first and second oil passages have respective straight parts which extend in parallel with each other.

14. An internal combustion engine as claimed in claim 4, in which said oil jet is directed toward a drive chain through which driving power of said crankshaft is transmitted to auxiliary parts of the engine.

* * * * *